US011148168B2

(12) United States Patent
Noniewicz

(10) Patent No.: US 11,148,168 B2
(45) Date of Patent: Oct. 19, 2021

(54) PISTON ASSEMBLY FOR A CARTRIDGE DISCHARGING DEVICE

(71) Applicant: WOLFCRAFT GMBH, Kempenich (DE)

(72) Inventor: Zbigniew Noniewicz, Kempenich (DE)

(73) Assignee: WOLFCRAFT GMBH, Kempenich (DE)

( * ) Notice: Subject to any disclaimer, the term of this patent is extended or adjusted under 35 U.S.C. 154(b) by 0 days.

(21) Appl. No.: 16/956,371

(22) PCT Filed: Dec. 12, 2018

(86) PCT No.: PCT/EP2018/084488
§ 371 (c)(1),
(2) Date: Jun. 19, 2020

(87) PCT Pub. No.: WO2019/121207
PCT Pub. Date: Jun. 27, 2019

(65) Prior Publication Data

US 2021/0086223 A1 Mar. 25, 2021

(30) Foreign Application Priority Data

Dec. 19, 2017 (DE) ..... 20 2017 107 724.1

(51) Int. Cl.
*B05C 17/005* (2006.01)
*B05C 17/01* (2006.01)
*B65D 83/00* (2006.01)

(52) U.S. Cl.
CPC .... *B05C 17/00576* (2013.01); *B05C 17/0123* (2013.01); *B65D 83/0005* (2013.01)

(58) Field of Classification Search
CPC ..... B05C 17/00576; B05C 17/0123; B65D 83/0005; A61M 5/31515; A61M 5/31511; A61M 5/31513
See application file for complete search history.

(56) References Cited

U.S. PATENT DOCUMENTS 2,688,325 A * 9/1954 Lockhart ..... A61B 5/150519 604/220
2,815,151 A * 12/1957 Collins ..... G01F 11/026 222/327

(Continued)

FOREIGN PATENT DOCUMENTS

CN 204523433 U 8/2015
DE 202010013511 U1 1/2011

(Continued)

*Primary Examiner* — Vishal Pancholi
*Assistant Examiner* — Bob Zadeh
(74) *Attorney, Agent, or Firm* — Lucas & Mercanti, LLP; Klaus P. Stoffel

(57) ABSTRACT

A piston assembly including a piston for a cartridge discharging device for discharging a pasty compound out of a cartridge which has an inner wall, having a piston and a rear face which can be acted upon by a pressure plate secured to a push rod, a front face opposite the rear face, and a retaining element which secures the pressure plate against the rear face by a retaining protrusion which covers an edge of the pressure plate in a retaining position. The retaining protrusion is secured to the piston in a movable manner into a release position in a direction away from the push rod.

11 Claims, 4 Drawing Sheets

(56) References Cited

U.S. PATENT DOCUMENTS

| | | | | | |
|---|---|---|---|---|---|
| 3,069,053 | A * | 12/1962 | Nilsson | B05C 17/0123 | 222/391 |
| 3,162,337 | A * | 12/1964 | Sabaka | B05C 17/014 | 222/327 |
| 4,678,107 | A | 7/1987 | Ennis | | |
| 4,911,695 | A * | 3/1990 | Lindner | A61M 5/14546 | 600/432 |
| 7,824,380 | B2 * | 11/2010 | Iijima | A61M 5/31511 | 604/218 |
| 8,986,251 | B2 * | 3/2015 | Fago | A61M 5/14546 | 604/131 |
| 9,630,204 | B2 * | 4/2017 | Hung | B05C 17/00576 | |
| 9,776,204 | B2 * | 10/2017 | Hung | B05C 17/00576 | |
| 2014/0008402 | A1 | 1/2014 | Dickson | | |

FOREIGN PATENT DOCUMENTS

| | | | |
|---|---|---|---|
| EP | 2116484 | A1 | 11/2009 |
| EP | 3075457 | A1 | 10/2016 |
| WO | 9608428 | A1 | 3/1996 |

* cited by examiner 9
23
16
22
18
19
8'
10
8
11
13
12
12'
1
2
7
9
4
6
3
8
8'
15'
15
13
11
9
10

11
22
15
8
25
11
7
12
22
8'

PISTON ASSEMBLY FOR A CARTRIDGE DISCHARGING DEVICE

CROSS-REFERENCE TO RELATED APPLICATIONS

The present application is a 371 of International application PCT/EP2018/084488, filed Dec. 12, 2018, which claims priority of DE 20 2017 107 724.1, filed Dec. 19, 2017, the priority of these applications is hereby claimed, and these applications are incorporated herein by reference.

BACKGROUND OF THE INVENTION

The invention relates to a piston assembly comprising a piston for a cartridge discharging device for discharging a pasty compound out of a cartridge, which has an inner wall, having a rear face, which can be acted upon by a pressure plate, a front face located opposite the rear face, and a retaining element, which, in a retaining position, secures the pressure plate against the rear face by means of a retaining protrusion, which engages over an edge of the pressure plate.

The invention furthermore also relates to a cartridge discharging device, which is formed with a piston assembly of this type.

A piston discharging device is known from US 2014/0084022 A1, in the case of which the piston is hook-connected to a pull cover connected to the push rod. The hooks starting at the piston engage with slots of the cover.

U.S. Pat. No. 3,162,337 discloses a cartridge discharging device, in the case of which a pressure plate is firmly connected to a push rod. The push rod engages with a rearward cup-shaped recess of the piston and is connected to the piston there in the manner of a bayonet closure.

U.S. Pat. No. 3,069,053 discloses a similar connection of a pressure plate to a piston.

EP 3 075 457 A1 describes a cartridge discharging device comprising a piston. The piston has a front face, which points in the direction of a pasty compound, which is to be discharged from a cartridge, wherein a second piston, which can be acted upon from the front face of the piston, can be arranged in the cartridge. The front face of the piston located opposite the rear face is fastened to a pressure plate, which is connected to the end of a push rod. The push rod can be linearly moved by means of an indexing gear by moving a drive lever back and forth, in order to move the piston in a discharge direction. The retaining element for securing the pressure plate to the rear face of the piston is formed here by a U-shaped web having an L-shaped cross section, which covers the edge of the pressure plate with a locking flank. The pressure plate can be inserted laterally into an opening. If a release lever of the cartridge discharging device is brought into a release position, the push rod can be pulled back. The piston is moved in the cartridge by means of the push rod.

A change piston for a cartridge discharging device, in the case of which retaining tongues engage with a groove, is known from DE 20 2010 013 511 U1.

Cartridge presses are furthermore also described in U.S. Pat. No. 3,069,053 and WO 96/08428.

SUMMARY OF THE INVENTION

The invention is based on the object of further developing a generic piston assembly comprising a piston for a cartridge discharging device or a cartridge discharging device, which is equipped with a piston assembly of this type, respectively, so as to be advantageous for use.

The piston assembly according to the invention has a piston comprising at least one first retaining protrusion, which is fastened to the piston in a deflectable manner in a direction away from the pressure plate. Due to a movement of the retaining protrusion relative to the pressure plate, the retaining protrusion is brought into a release position, in which the pressure plate can be separated from the piston in the direction away from the rear face. It is in particular provided that the retaining protrusion is fastened to the piston in an elastically deflectable manner. For this purpose, the retaining protrusion can be fastened to the piston via a spring web. Two or more retaining protrusions can be provided, which are each fastened to the piston in particular in an elastically deflectable manner. Two retaining protrusions can be located opposite one another. It is in particular provided that the pressure plate is connected with its center to a push rod, which can be linearly moved in order to discharge the pasty compound out of the cartridge. The push rod defines an axis. The two retaining protrusions are arranged diametrically relative to the axis. A limitation protrusion can furthermore be provided, which forms a contact flank, against which the edge of the pressure plate abuts. The limitation protrusion can be formed by a curved limiting rib. The contact flank is in particular arranged at a limiting rib, which runs on the circumferential contour line of the piston between two retaining elements. The retaining elements can preferably be moved from the retaining position into a release position only when the piston is not located in a cartridge. For this purpose, it is in particular provided that the retaining element has a support flank. The support flank preferably points radially to the outside and moves radially to the outside when moving the retaining element from the retaining position into the release position. The support flank has such a radial distance to the axis of the piston that the inner wall of the cartridge lies in the movement path in the support flank when it is moved in the direction of the release position. The inner wall of the cartridge, together with the support flank, thus forms a locking mechanism, by means of which the retaining element is retained in the retaining position, when the piston is located in the cartridge. The support flank is thus arranged in such a way that, by striking or abutting against the inner wall of the cartridge, it prevents an escape, in particular an elastic escape of the retaining element into the release position when the piston is inserted into the cartridge. For this purpose, the support flank can be formed by a support arm, which is arranged at a free end of the spring web. The support arm protrudes radially to the outside. The retaining protrusion, which, on its side, which points to the rear face, forms the blocking flank, which engages over the edge of the pressure plate in the retaining position, furthermore also sits at the free end of the spring arm. It can be provided that the support flank or the support arm forming the support flank, respectively, has a larger axial distance to the rear face than the retaining protrusion. A side of the spring web pointing away from the edge of the pressure plate can be spaced apart from the inner wall of the cartridge by a radial distance. This radial distance is bridged by the support arm. The front face of the piston is formed by a pressure portion, which has a truncated cone-shaped outer wall. The front face has a radially outer peripheral edge, the radial distance of which corresponds approximately to the radial distance of the support flank from the axis. The retaining protrusion can have a run-on bevel, which points away from the locking flank. The edge of the pressure plate abuts against this run-on bevel when the pressure plate is assigned to the piston. Due to a run-on of the edge of the pressure plate on the run-on bevel, the retaining elements are pivoted into the release position. The spring web thereby bends elastically and subsequently snaps back into the retaining position, in which the retaining protrusion engages over the edge of the pressure plate. The retaining elements are connected in particular integrally to the piston, which consists of plastic. The piston, which consists of plastic, can have a radial slot, so that it can also be inserted into such cartridges or tubes, the inner diameter of which is slightly larger than the diameter of the edge of the front face. By compressing the gap, the circumferential length of the edge of the front face decreases. The front face is in particular formed by a bowl-shaped depression.

BRIEF DESCRIPTION OF THE DRAWINGS

The invention will be described in more detail below on the basis of exemplary embodiments, in which.

DETAILED DESCRIPTION OF THE INVENTION

Figure 1:
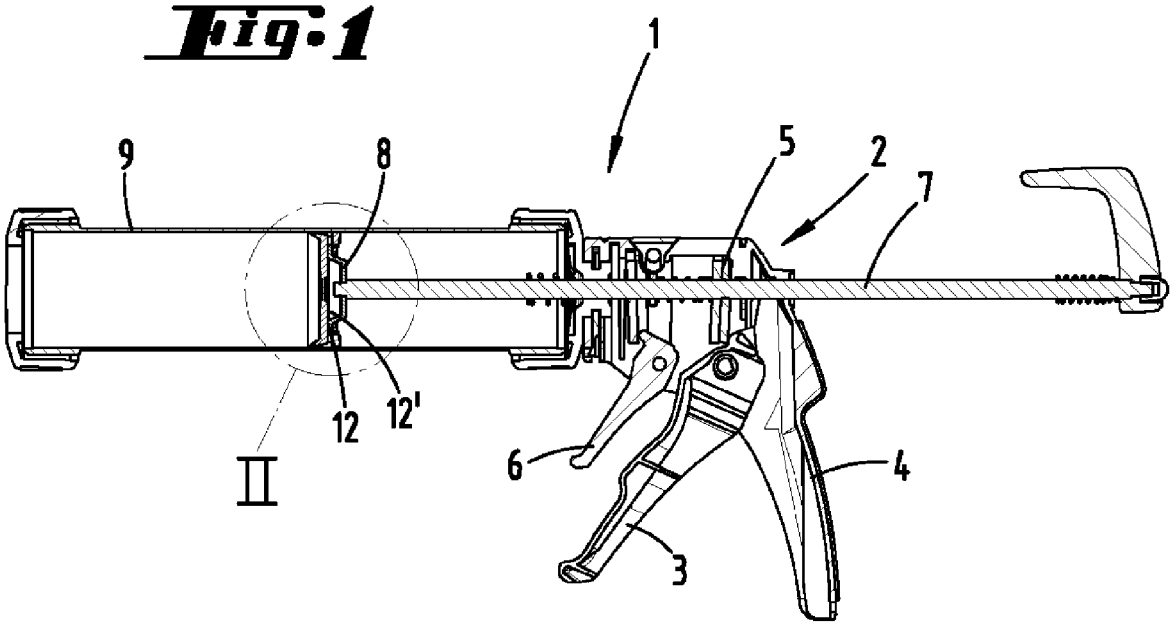
FIG. 1 shows a longitudinal section through a cartridge press.
Figure 2:
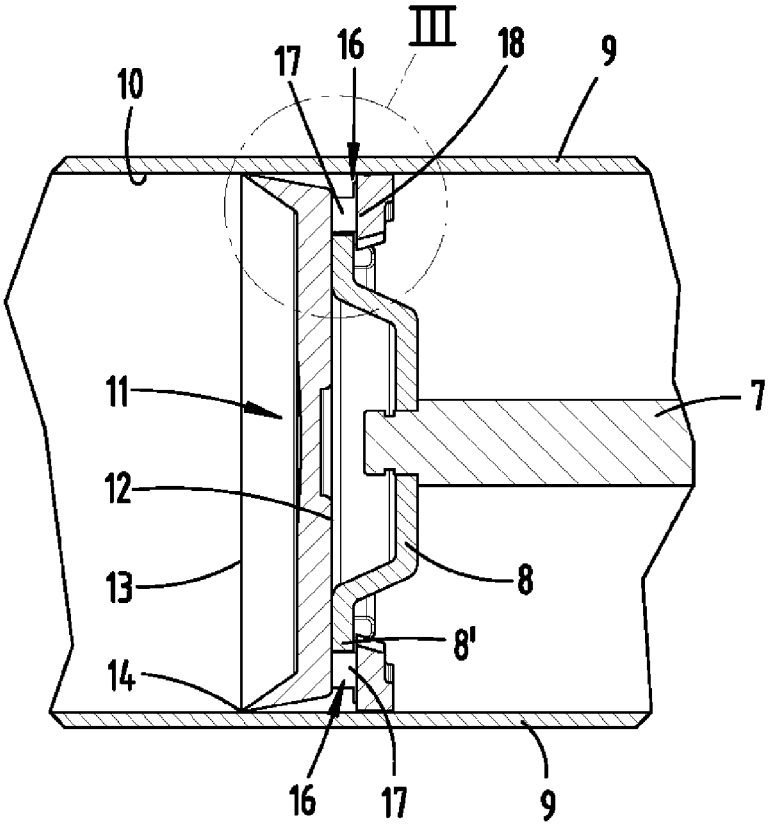
FIG. 2 shows the section II in FIG. 1 in an enlarged manner.
Figure 3:
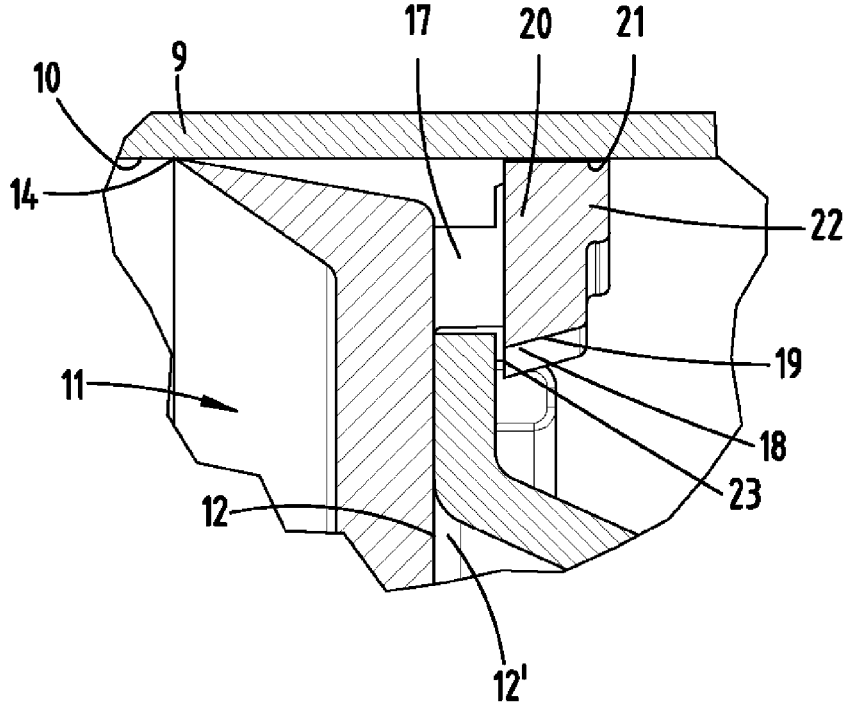
FIG. 3 shows the section III in FIG. 2 in an enlarged manner.
Figure 4:
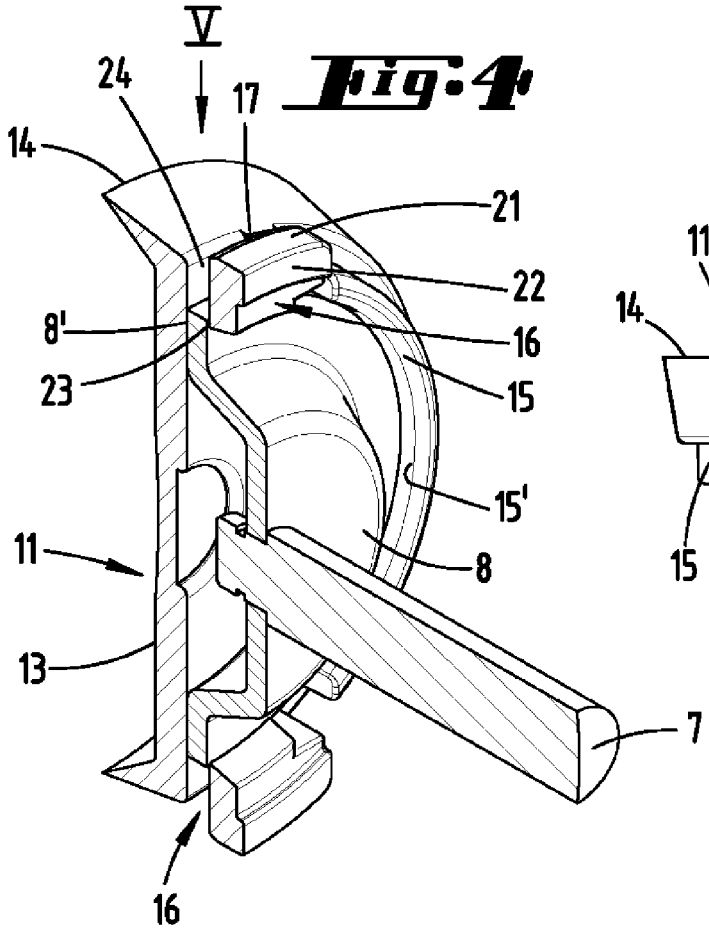
FIG. 4 shows a piston according to the invention, which is connected to a pressure plunger 8, in a perspective and cut manner.
Figure 5:
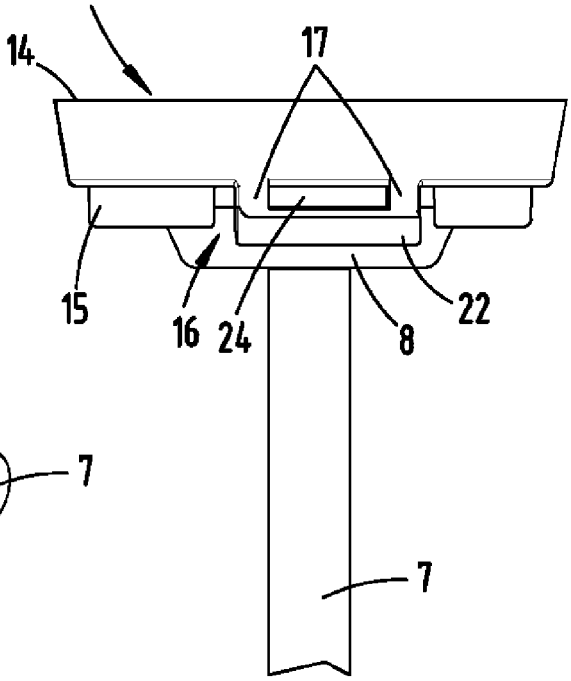
FIG. 5 shows a side view onto the piston 11, which is fastened to a pressure plate 8.
Figure 6:
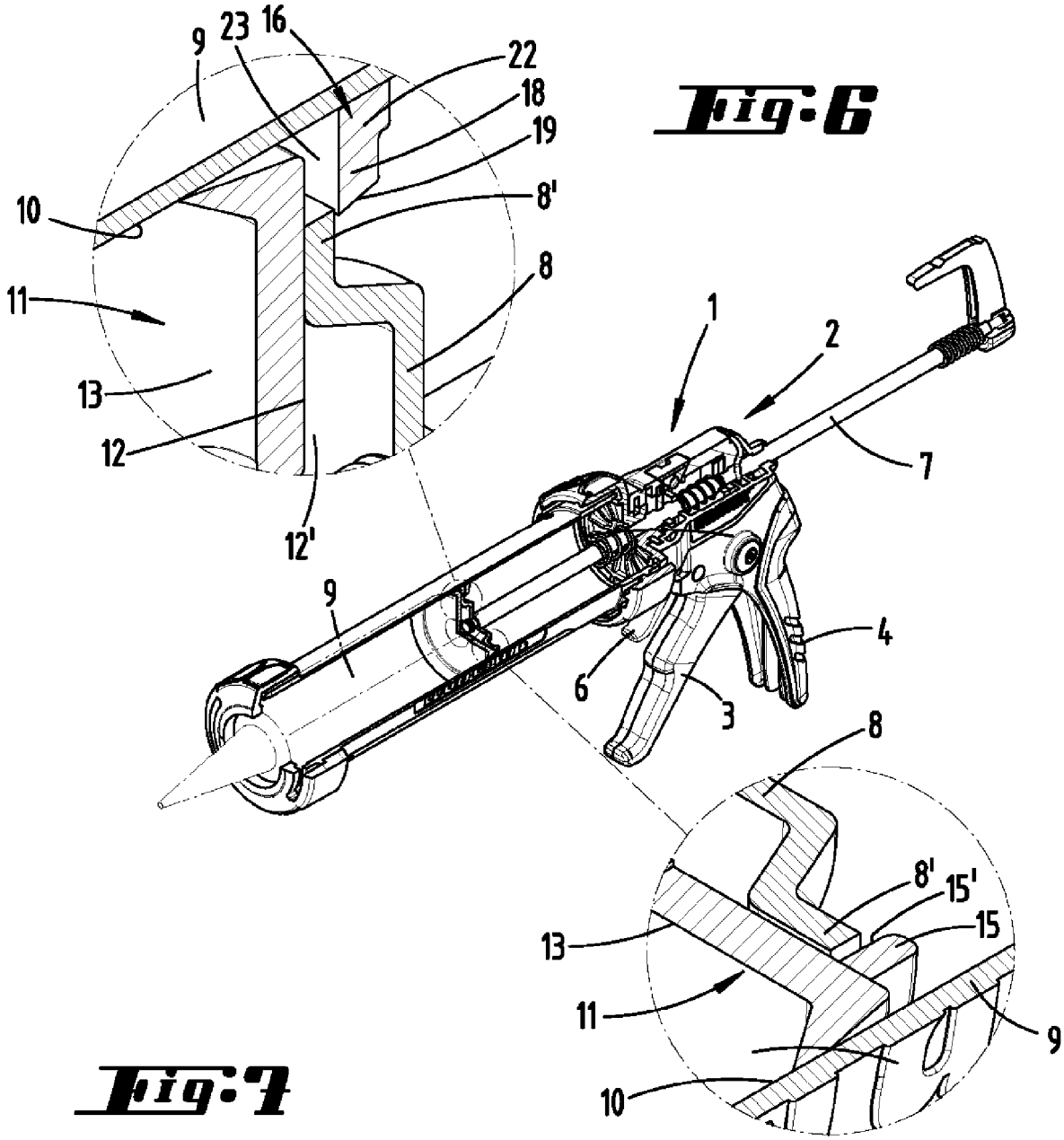
FIG. 6 shows a perspective illustration of the cartridge press illustrated in FIG. 1 with a breakup.

The exemplary embodiment of the invention relates to a cartridge press 1, which has an actuating housing 2, in which a push rod 7 is linearly guided. The push rod 7 can be gradually moved in a discharge direction by a pivoting actuation of a drive lever 3 in the direction of a handle 4 by means of entrainment elements 5. The actuation of a release lever 6 is required to move the push rod 7 back. With regard to the mode of operation of a cartridge press of this type, reference is made to the pertinent prior art, in particular to DE 20 2016 101 734 U1 or to non-published DE 10 2017 100 627.

At its free end, the push rod 7 bears a pressure plate 8, which has an outer edge 8'. With this outer edge 8', the pressure plate 8 is secured to a piston 11 as follows according to the invention. The pressure plate 8 has a rotational symmetry.

The piston 11 is an integral body made of plastic, which has a front face 13, which has a circular outline. A peripheral edge 14 surrounding the front face 13 runs on a circular arc line. The peripheral edge 14 surrounds a bowl-shaped depression. A truncated cone-shaped surface adjoins the peripheral edge 14. A rear face 12, which receives a receiving clearance 12' for receiving the pressure plate 8, is located opposite the front face 13.

The receiving clearance 12' is limited by two limiting ribs 15, which are located opposite one another and which run on a circular arc line and which each form a contact flank 15' for abutting against the edge 8' of the pressure plate 8. A radial slot divides the limiting rib 15 into two halves, wherein the radial slot also divides the base body, which forms the bowl-shaped depression.

Two retaining elements 16 are provided, which are located diametrically opposite one another—relative to the push rod 7, which is arranged in the axis of the pressure plate 8. Each of the two retaining elements 16 forms a retaining protrusion 18 comprising a locking flank 23. The locking flank 23 lies in a retaining position above the edge 8' of the pressure plate 8, in order to secure the pressure plate 8 to the piston 11.

On its side located opposite the locking flank 23, the retaining protrusion 18 has a run-on bevel 19 and is fastened to a free end of the spring web 17. The spring web 17 extends away from the base body of the piston 11, which has a truncated cone shape, in the axial direction—relative to the axis of the pressure plate 8. The spring web 17 has a radial distance from a circumferential circular arc line, which is defined by the course of the peripheral edge 14. The distance of the spring web 17 to the axis is smaller than the radius of the edge 14.

By a radial bending of the spring webs 17 against an elastic restoring force, the locking flanks 23 can be brought from a retaining position engaging over the edge, into a release position, in which the pressure plate 8 can be separated from the piston 11 in the axial direction.

Figure 7:
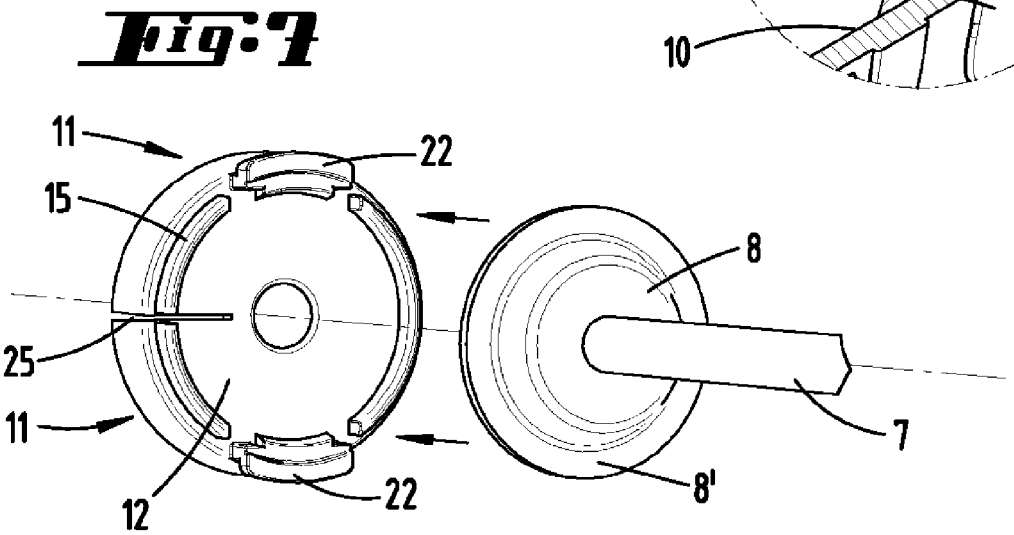
FIG. 7 shows a perspective illustration of the piston facing the rear face 12.
Figure 7A:
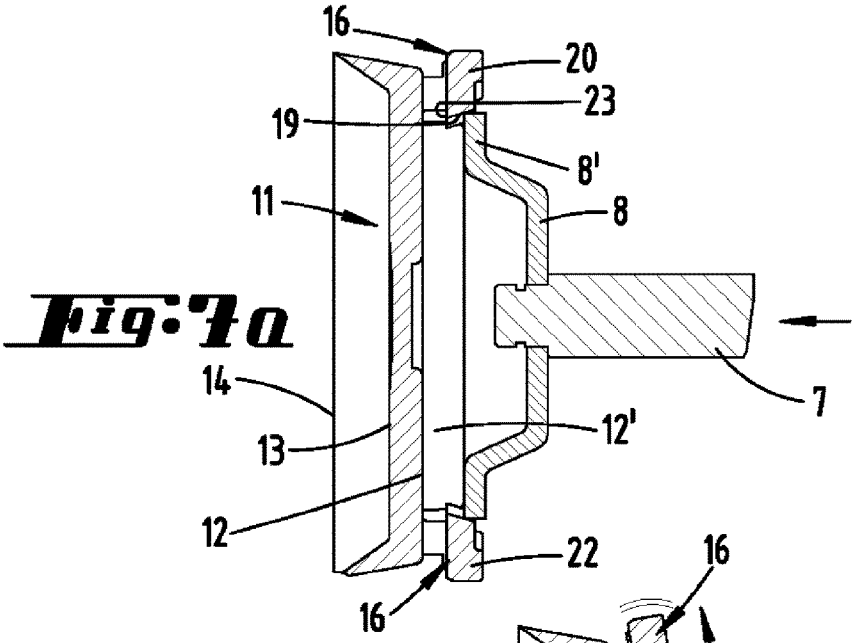
FIG. 7*a* shows a sectional illustration similar to FIG. 2 when fastening a pressure plate 8 to a piston 11, wherein the edge 8' acts on a run-on bevel 19.
Figure 7B:
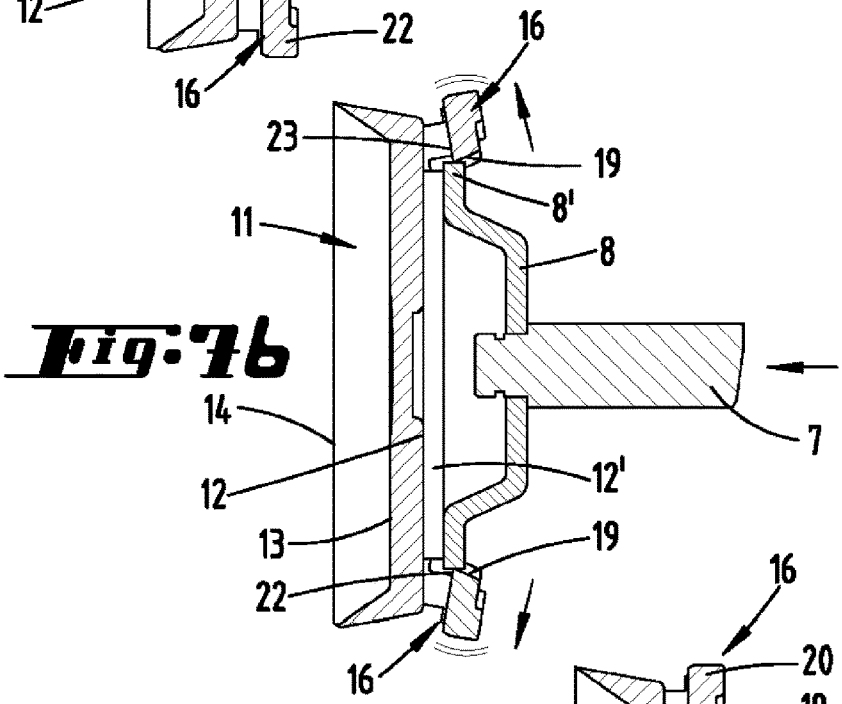
FIG. 7*b* shows a follow-up illustration for FIG. 7*a*, after the pressure plate 8 has brought retaining elements 16 into a release position.
Figure 7C:
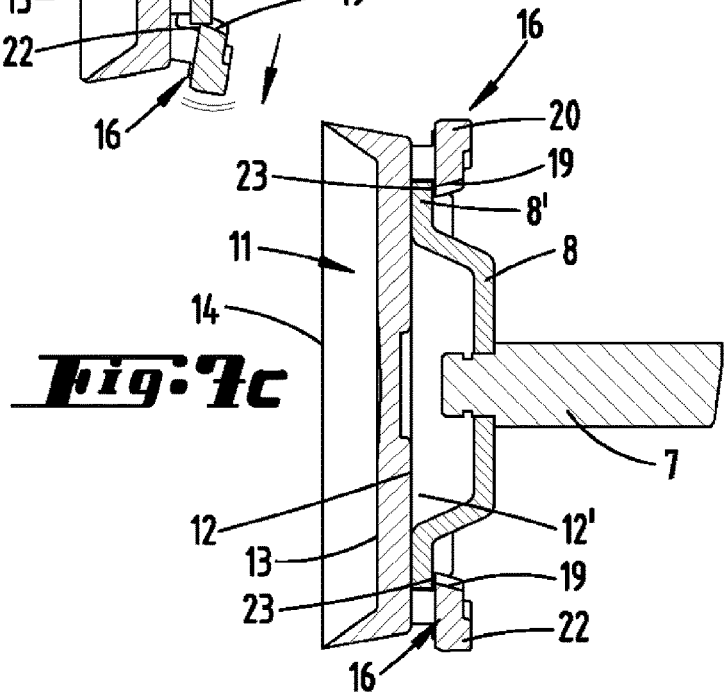
FIG. 7*c* shows a further follow-up illustration, after the retaining elements 16 have assumed their retaining position.

To assign the pressure plate 8 to the piston 11, it can be moved in the axial direction towards the rear face 12 (FIG. 7*a*). The edge 8' thereby slides on the run-on bevel 19 and bends the spring web 17 in the radial outwards direction (FIG. 7*b*), until the retaining protrusion 18 snaps back into the retaining position (FIG. 7*c*).

According to the invention, a support arm 20 is fastened to the retaining protrusion 18 and in particular to the free end thereof. The support arm 20 protrudes in the radially outward direction and forms a support flank 21 with a circumferential line. This support flank 21 has approximately the same radial distance to the axis as the edge 14.

A protrusion 22 protrudes from the radially outermost section of the support arm 20. Due to the fact that the protrusion 22 protrudes from the support arm 20 in the axial direction, it can be used as actuating handle, in order to pivot the retaining element 16 from a retaining position into a release position.

With an inner wall 10 of a cartridge 9 or of a tube, the support flank 21 forms a locking element, which prevents that the piston 11, which is inserted into this cartridge, can separate from the pressure plate 8. This is so, because the radial distance of the inner wall 10 to the support flank 21 is smaller than the radial length of the engagement of the locking flank 23 over the edge 8' of the pressure plate 8. If a force, which generates a torque, which acts upon the retaining element 16 in the direction of the release position, thus, generally speaking, bends the spring web 17 in the radially outward direction, is applied to the locking flank 23, for example by applying tension on the push rod 7 in the direction away from the piston 11, the support flank 21 abuts against the inner wall 10 of the cartridge 9 and thus prevents that the locking flank 23 loses its locking effect, which engages over the edge 8'. In the case of the exemplary embodiment, it is provided in particular that the diameter of the edge 14 is slightly larger than the inner diameter of the tube forming the cartridge 9. The support flanks 21 run on the same circumferential circle. If a piston 11 of this type is inserted into the cartridge 9, the radial slot 25 has to be compressed slightly. The two retaining elements 16 located opposite one another also have to be moved slightly towards one another. The support flanks 21 then abut against the inner wall 10 with a slight spring bias.

It is further provided in the case of the exemplary embodiment that a window is formed between two spring webs 17, so that the support arm 20 or the retaining protrusion 18, respectively, is connected to the base body, which has a truncated cone-shaped, by means of two spring webs 17.

The above explanations serve to describe the inventions, which are captured as a whole by the application, and which further develop the prior art at least by means of the following feature combinations, in each case also independently, whereby two, several, or all of these feature combinations can also be combined, namely:

A piston assembly, which is characterized in that the retaining protrusion 18 is fastened to the piston 11 in a movable manner into a release position in a direction away from the push rod 7.

A piston assembly, which is characterized in that the retaining protrusion 18 is fastened to the piston 11 in an elastically deflectable manner.

A piston assembly, which is characterized in that the retaining element 16 forms a spring web 17, by means of which the retaining protrusion 18 is fastened to the piston 11.

A piston assembly, which is characterized by a second retaining protrusion 18, which is located opposite the retaining protrusion 18 and which can in particular likewise be elastically moved into a release position.

A piston assembly, which is characterized by a contact flank 15' for abutting against the edge 8' of the pressure plate 8.

A piston assembly, which is characterized in that the contact flank 15' is formed by a limiting rib 15.

A piston assembly, which is characterized in that the retaining element 16 has a support flank 21, which, by striking or abutting against the inner wall 10 of the cartridge 9, prevents an escape of the retaining element 16 into the release position when the piston 11 is inserted into the cartridge 9.

A piston assembly, which is characterized in that the support flank 21 is formed by a support arm 20.

A piston assembly, which is characterized in that a run-on bevel 19 is located opposite a locking flank 23 of the retaining protrusion 18.

A cartridge press, in the case of which the push rod (7) is moved by actuating a drive lever (3).

All disclosed features (alone, but also in combination with one another), are essential for the invention. The disclosure content of the corresponding/enclosed priority documents (copy of the prior application) is hereby also included in its entirety into the disclosure of the application, also for the purpose of adding features of these documents into claims of the present application. Even without the features of a referenced claim, the subclaims characterize with their features independent inventive further developments of the prior art, in particular in order to file divisional applications on the basis of these claims. The invention specified in each claim can additionally have one or several of the features, which are specified in the above description, in particular provided with reference numerals, and/or which are specified in the list of reference numerals. The invention also relates to forms of designs, in the case of which individual features of the ones mentioned in the above description are not realized, in particular insofar as they are obviously dispensable for the respective intended use or can be replaced by other means, which have the same technical effect.

LIST OF REFERENCE NUMERALS

1 cartridge discharging device
2 actuating housing
3 drive lever
4 handle
5 entrainment element
6 release lever
7 push rod
8 pressure plate
8' edge
9 cartridge
10 inner wall
11 piston
12 rear face
12' receiving clearance
13 front face
14 edge of the front face
15 limiting rib
15' contact flank
16 retaining element
17 spring web
18 retaining protrusion
19 run-on bevel
20 support arm
21 support flank
22 protrusion
23 locking flank
24 window
25 slot

The invention claimed is:

1. A piston assembly for a cartridge discharging device for discharging a pasty compound out of a cartridge, which has an inner wall, comprising: a piston having a rear face and a front face located opposite the rear face; a push rod; a pressure plate that is fastened to the push rod and acts on the rear face; and, a retaining element, which, in a retaining position, secures the pressure plate against the rear face by a retaining protrusion that engages over an edge of the pressure plate, wherein the retaining protrusion is fastened to the piston in a movable manner into a release position in a direction away from the push rod, wherein the retaining element has a support flank configure to strike or abut against the inner wall of the cartridge so as to prevent an escape of the retaining element into the release position when the piston is inserted into the cartridge.

2. The piston assembly according to claim 1, wherein the retaining protrusion is fastened to the piston in an elastically deflectable manner.

3. The piston assembly according to claim 2, wherein the retaining element forms a spring web that fastens the retaining protrusion to the piston.

4. The piston assembly according to claim 3, further comprising a second retaining protrusion located opposite the retaining protrusion and elastically movable into a release position.

5. The piston assembly according to claim 4, wherein the piston has a contact flank for abutting against the edge of the pressure plate.

6. The piston assembly according to claim 1, wherein the piston has a contact flank for abutting against the edge of the pressure plate.

7. The piston assembly according to claim 6, wherein the contact flank is formed by a limiting rib.

8. The piston assembly according to claim 6, wherein the support flank is formed by a support arm.

9. The piston assembly according to claim 1, wherein the support flank is formed by a support arm.

10. The piston assembly according to claim 1, wherein a run-on bevel is located opposite a locking flank of the retaining protrusion.

11. A cartridge press, comprising: a piston assembly according to claim 1; and a drive lever actuatable to move the push rod.

* * * * *